US007980008B2

(12) United States Patent
Song

(10) Patent No.: US 7,980,008 B2
(45) Date of Patent: Jul. 19, 2011

(54) FOOTWEAR FOR THREE-BEAT RHYTHM WALKING

(76) Inventor: Sam-Gun Song, Pusan (KR)

( * ) Notice: Subject to any disclaimer, the term of this patent is extended or adjusted under 35 U.S.C. 154(b) by 785 days.

(21) Appl. No.: 11/791,516

(22) PCT Filed: Jan. 26, 2007

(86) PCT No.: PCT/KR2007/000466

§ 371 (c)(1),
(2), (4) Date: Sep. 25, 2007

(87) PCT Pub. No.: WO2007/132975

PCT Pub. Date: Nov. 22, 2007

(65) Prior Publication Data

US 2009/0119949 A1 May 14, 2009

(30) Foreign Application Priority Data

May 16, 2006 (KR) ..... 10-2006-0043959

(51) Int. Cl.

| | |
|---|---|
| ***A43B 13/00*** | (2006.01) |
| ***A43B 13/20*** | (2006.01) |
| ***A43B 13/28*** | (2006.01) |
| ***A43B 7/06*** | (2006.01) |

(52) U.S. Cl. ..... 36/103; 36/3 B; 36/27; 36/29

(58) Field of Classification Search ..... 36/105, 36/103, 3 R, 3 A, 3 B, 29, 37, 35 B, 147, 36/27, 38, 35 R, 28

See application file for complete search history.

(56) References Cited

U.S. PATENT DOCUMENTS

| | | | | | |
|---|---|---|---|---|---|
| 1,011,460 | A | * | 12/1911 | Maddocks | 36/29 |
| 1,021,751 | A | * | 3/1912 | Mathis | 36/38 |
| 4,348,821 | A | * | 9/1982 | Daswick | 36/103 |
| 4,875,683 | A | * | 10/1989 | Wellman et al. | 473/217 |
| 4,905,382 | A | * | 3/1990 | Yung-Mao | 36/28 |
| 5,341,581 | A | * | 8/1994 | Huang | 36/3 B |
| 5,551,173 | A | * | 9/1996 | Chambers | 36/44 |
| 5,815,949 | A | * | 10/1998 | Sessa | 36/3 B |
| 5,975,861 | A | * | 11/1999 | Shin et al. | 417/234 |

(Continued)

FOREIGN PATENT DOCUMENTS

| | | | |
|---|---|---|---|
| JP | 09-294607 | A | 11/1997 |
| JP | 2002-238613 | A | 8/2002 |

(Continued)

*Primary Examiner* — Jila M Mohandesi
*Assistant Examiner* — Melissa L Lalli
(74) *Attorney, Agent, or Firm* — Daniel P. Burke & Associates, PLLC

(57) ABSTRACT

Disclosed herein is footwear for three-beat rhythm walking. The footwear includes an outsole (S) having a first landing part (100) for landing a heel, a second landing part (200) for landing a center of a foot, and a third landing part (300) for landing a toe. The first landing part (100) includes a landing guide groove (110) which is curved inwards from a junction (C) of the first landing part and the second landing part (200) in such a way as to extend widthwise and forms a first beat of the heel landing on a ground. A rolling landing surface (120) is connected to the landing guide groove (110) to form a continuous curve, thus guiding rolling and landing of the heel. An air cushion (130) is provided in the first landing part, and absorbs shocks of the heel, which rolls and lands using the rolling landing surface (120).

14 Claims, 6 Drawing Sheets

U.S. PATENT DOCUMENTS

| | | | | |
|---|---|---|---|---|
| 7,020,988 | B1 * | 4/2006 | Holden et al. | 36/35 B |
| 2004/0010939 | A1 * | 1/2004 | Liu et al. | 36/29 |
| 2006/0143943 | A1 * | 7/2006 | Cho et al. | 36/3 B |
| 2007/0294916 | A1 * | 12/2007 | Park | 36/29 |

FOREIGN PATENT DOCUMENTS

| | | | |
|---|---|---|---|
| KR | 20-2000-0001112 | U | 1/2000 |
| KR | 20-0403326 | Y1 | 12/2005 |
| WO | WO 2004-105546 | A2 | 12/2004 |

* cited by examiner

[Fig. 3]
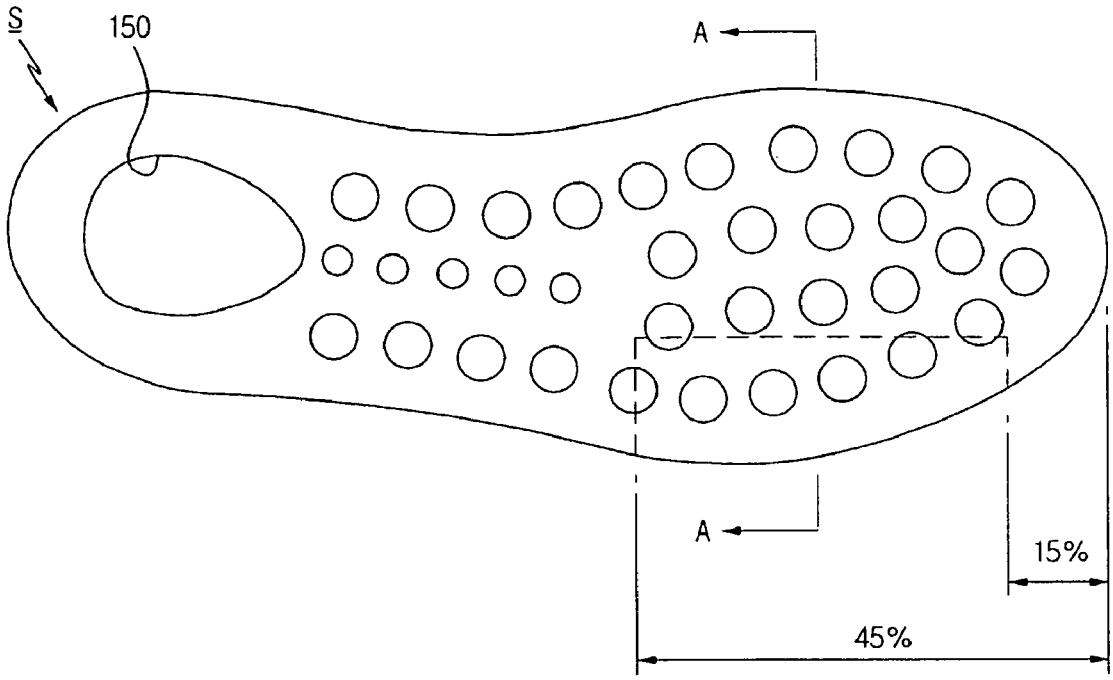
[Fig. 4]
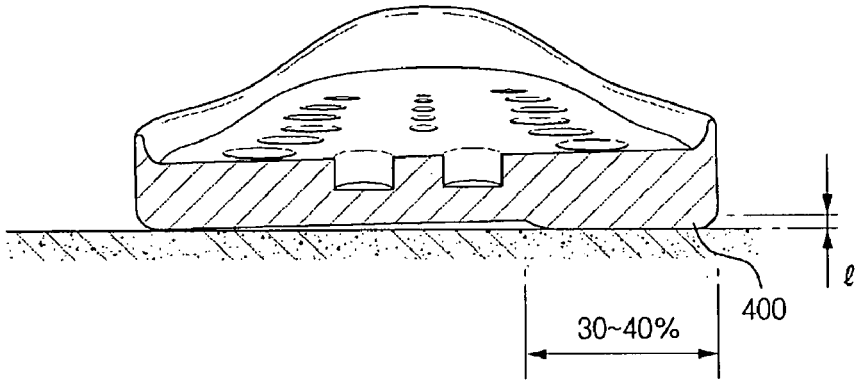

[Fig. 5]
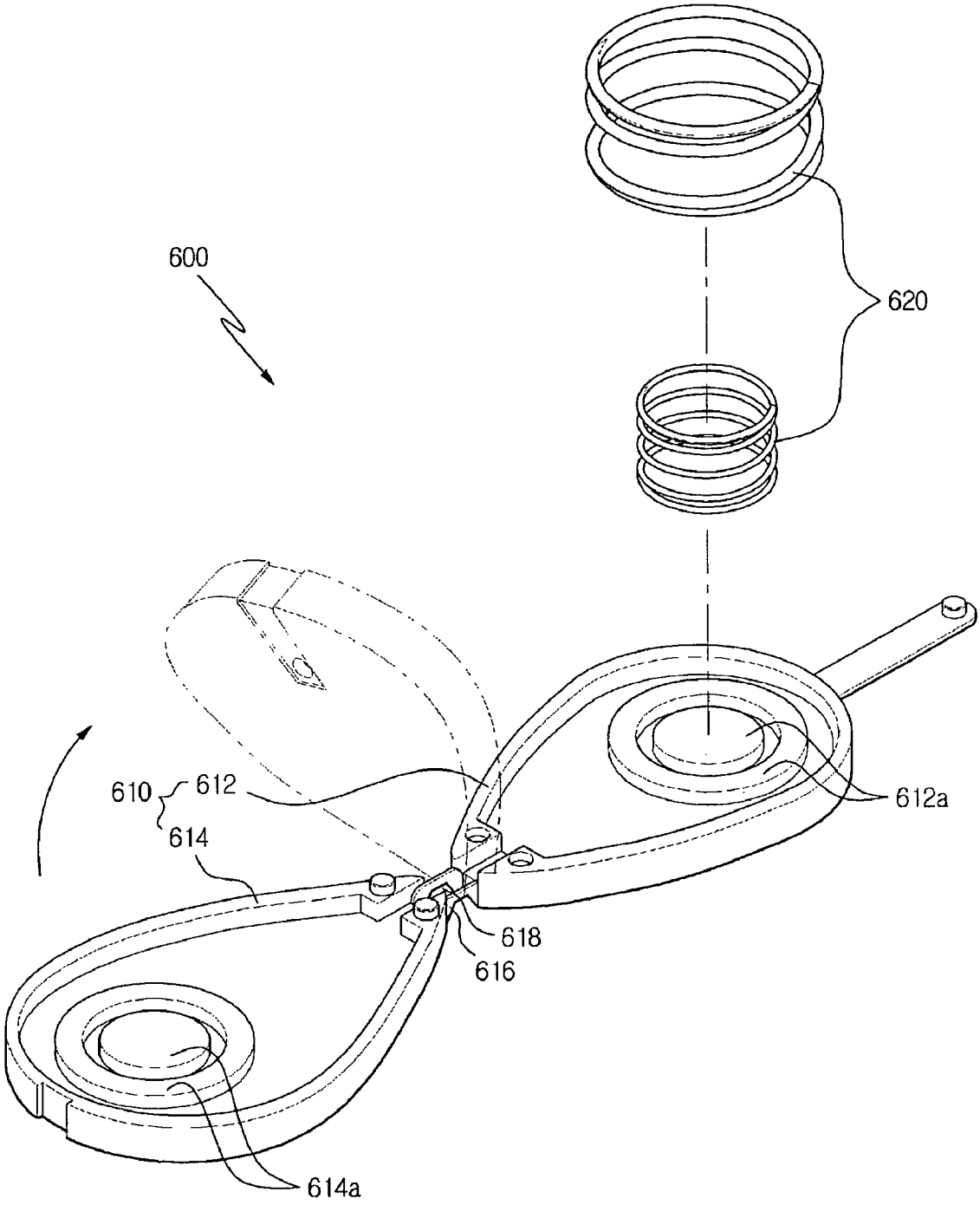

[Fig. 6]
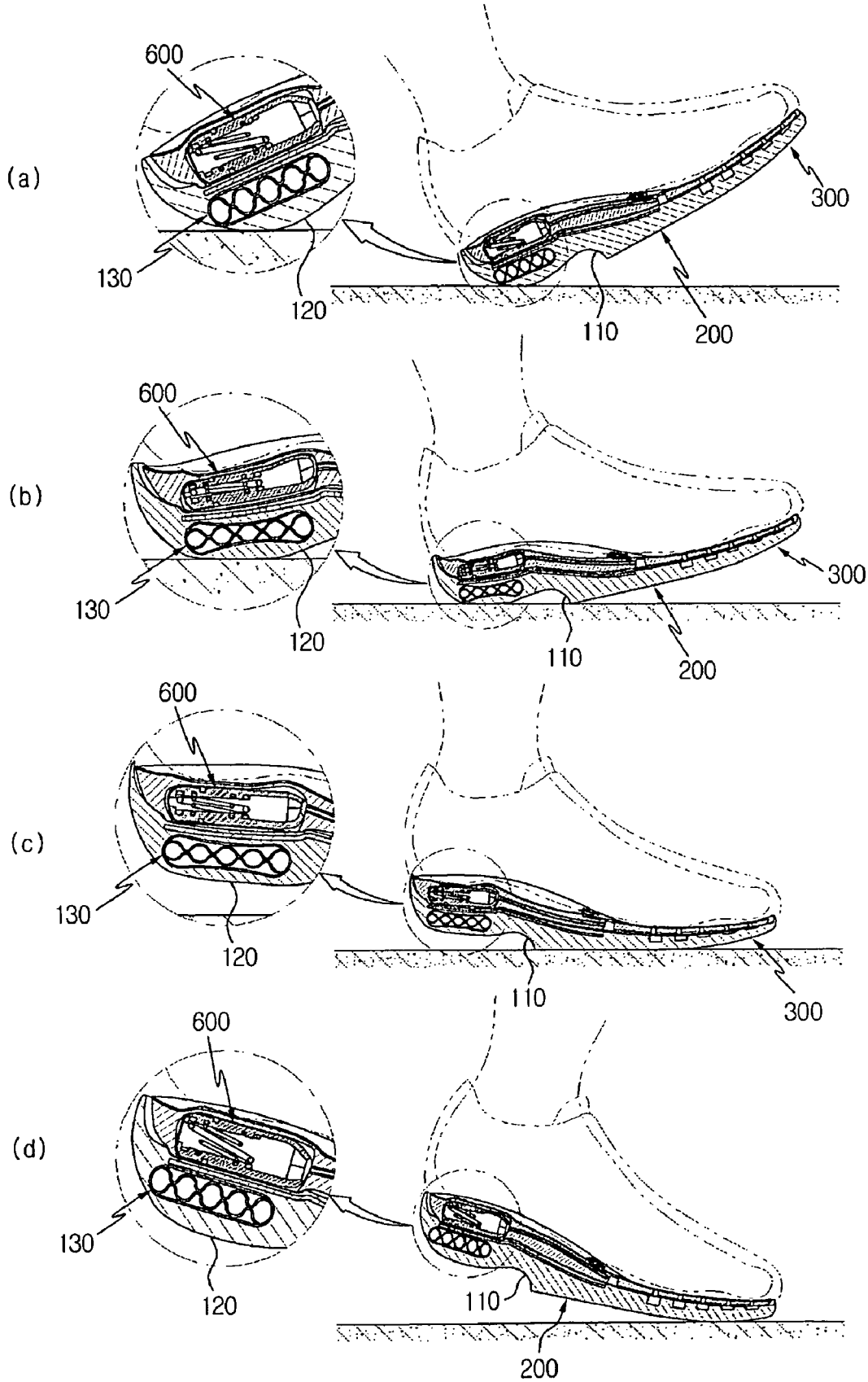

[Fig. 7]
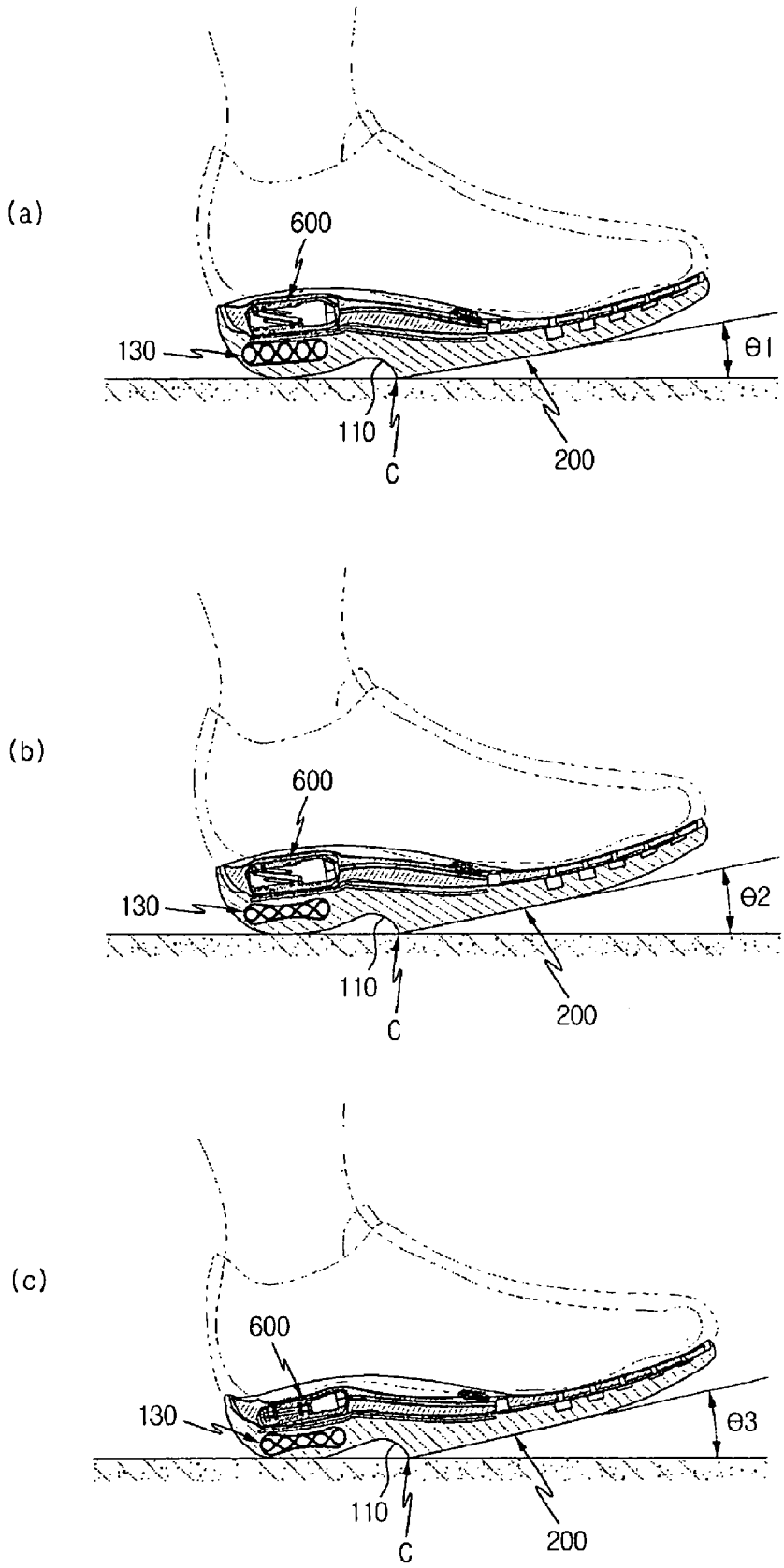

FOOTWEAR FOR THREE-BEAT RHYTHM WALKING

TECHNICAL FIELD

The present invention relates, in general, to footwear for three-beat rhythm walking and, more particularly, to footwear for three-beat rhythm walking, which allows a walker who walks in a three-beat rhythm to smoothly roll and land, and absorbs shocks of the heel, thus preventing pain in his or her ankle, calf, knee joint, and thigh, and which mitigates shocks acting on the walker and provides elasticity, thus permitting rhythmic walking.

Further, the present invention relates to footwear for three-beat rhythm walking, which is applied to Korean Patent No. 576381, entitled "Footwear Having Insole" and filed in 2005 by the applicant of this invention, and which is capable of absorbing shocks acting on a walker who walks in a three-beat rhythm.

BACKGROUND ART

Footwear is worn on the feet so that a wearer can stand on the ground or walk. When a wearer walks with the footwear on, a so-called "three-beat rhythm" walking method is widely known to be the most preferable walking method. This walking method is performed as if a wearer rolled forwards while his or her sole contacts the ground in the sequence of the heel, the center of the foot, and the toes, in the state where the wearer stretches his or her backbone and leans his or her head slightly backwards.

In order to maintain such a three-beat rhythm walking method, Korean Patent No. 239854, which was filed in 1998 and is entitled "Footwear For Promoting Health" was proposed. According to the cited document, the footwear includes an outsole which has front and rear inclination parts that are inclined upwards at anterior and posterior portions of the bottom of the outsole, an upper which is attached to the upper portion of the outsole and protects the foot, and front and rear grooves which are formed in the front and rear inclination parts. The front and rear inclination parts, which are formed on the anterior and posterior portions of the footwear, allow a wearer to naturally walk in a three-beat rhythm.

The conventional footwear is constructed so that the outsole contacts the ground in the sequence of the rear inclination part, corresponding to the heel, the bottom part, corresponding to the center of the foot, and the front inclination part, corresponding to the toes. However, the conventional footwear is problematic in that it cannot satisfactorily absorb shocks applied by a walker's weight, so that the shocks are directly transmitted to the walker, and thus he or she may suffer pain in the ankle, the calf, the knee joint, or the thigh, and his or her fatigue may be increased.

Particularly, according to the prior art, an iron piece made of a metal material is inserted into the outsole so as to maintain the overall shape of the outsole. However, such an iron piece undesirably increases the severity of shocks transmitted to a walker.

Further, the conventional footwear is problematic in that the rear inclination part comprises a flat horizontal plane, so that all of a walker's heel contacts the ground at one time, thus a walking rhythm is interrupted, and the ankle, the calf, the knee joint, and the thigh are overstrained.

Moreover, when three-beat rhythm walking, it is preferable that the toes contact the ground in the sequence from the little toe to the big toe. However, the conventional footwear is problematic in that the front inclination part comprises a flat horizontal plane, so that it is impossible to make a walker's toes contact the ground in the sequence from the little toe to the big toe.

DISCLOSURE OF INVENTION

Technical Problem

Accordingly, the present invention has been made keeping in mind the above problems occurring in the prior art, and an object of the present invention is to provide footwear for three-beat rhythm walking, which allows a walker who walks in a three-beat rhythm to smoothly roll and land, and absorbs shocks of the heel, thus preventing pain in his or her ankle, calf, knee joint, and thigh, and which mitigates shocks acting on the walker and provides elasticity, thus permitting rhythmic walking.

Another object of the present invention is to provide footwear for three-beat rhythm walking, which is applied to Korean Patent No. 576381, entitled "Footwear Having Insole" and filed in 2005 by the applicant of this invention, and which is capable of absorbing shocks acting on a walker who walks in a three-beat rhythm.

Technical Solution

In order to accomplish the objects, the present invention provides footwear for three-beat rhythm walking, including an outsole having a first landing part for landing a heel, a second landing part for landing a center of a foot, and a third landing part for landing a toe, wherein the first landing part includes a landing guide groove which is curved inwards from a junction of the first landing part and the second landing part in such a way as to extend widthwise, and forms a first beat of the heel landing on a ground, a rolling landing surface which is connected to the landing guide groove to form a continuous curve, thus guiding rolling and landing of the heel, and an air cushion which is provided in the first landing part and absorbs shocks of the heel, which rolls and lands using the rolling landing surface. The outsole has on an upper surface thereof an insole, the insole comprising a plurality of vertical air holes which are bored through the insole to communicate with each other, and a mounting cavity which is coupled to the vertical air holes and is defined in a lower surface of the insole contacting the heel. A shock absorbing unit is mounted to the mounting cavity to elastically absorb shocks of the heel and supply air to the vertical air holes.

Preferably, an inclination angle between a segment extending from the junction to a tangent line of the rolling landing surface and the ground is from 11° to 13°. The first landing part, the second landing part, and the third landing part have proportions of 33~37%:42~46%:19~23% relative to a total length of the outsole.

The air cushion includes a chamber which is made of an elastic material to be elastically compressed and extended by the shocks of the heel, and is filled with air, and a shock absorbing protrusion which is provided in the chamber to correspond to upper and lower surfaces of the chamber, and absorbs the shocks of the heel.

The first landing part is spaced apart from the ground when the second landing part lands on the ground.

A balance protrusion is integrally provided on the outsole in such a way as to protrude downwards, the balance protrusion allowing a walker's toes to contact the ground in a sequence from a little toe to a big toe, when a step is transferred from the second landing part to the third landing part. The balance protrusion is provided on a landing surface between a point spaced apart from a front end of the outsole by 15% of a length of the outsole and a point spaced apart from the front end of the outsole by 45% of the length of the outsole, and extends from an outside end of the outsole to a point corresponding to 30 to 40% of a width of the outsole.

Further, the balance protrusion has a thickness from 1 to 2 mm, and protrudes slightly in a direction from an inside end of the outsole to the outside end thereof.

A plurality of shock absorbing protuberances is integrally provided on the lower surface of the insole, and absorbs shocks of the third landing part for landing the toe. A dispersion hole is vertically formed in each of the shock absorbing protuberances to disperse the shocks of the third landing part.

Further, heights of the shock absorbing protuberances are reduced in a direction from a rear end of the insole to a front end thereof.

The shock absorbing unit includes a casing which is made of an elastic material and has an air supply hole to supply air through an air tube to the vertical air holes, and an elastic member which is provided in the casing and absorbs the shocks of the heel. The casing includes a main body and a cover which is coupled to the main body via a folding coupling piece in such a way as to be opened or closed, the air supply hole formed in the folding coupling piece.

The elastic member comprises a coil spring, and is supported by support rings which are provided in the main body and the cover so as to correspond to each other.

Preferably, an inclination angle between the second landing part and the ground is from 15° to 17° when the first landing part lands on the ground.

Furthermore, a plurality of first acupressure protuberances is integrally provided on the insole, and presses the sole of the foot. A plurality of second acupressure protuberances is integrally provided on the insole, and presses a Yung-Chuan region of the sole.

An end rim protrudes from an outer end of the mounting cavity, and a seating recess is formed on an upper surface of the outsole to determine a position at which the end rim is attached.

Advantageous Effects

First, the present invention provides footwear for three-beat rhythm walking, which allows a walker who walks in a three-beat rhythm to smoothly roll and land, and absorbs shocks of the heel, thus preventing pain in his or her ankle, calf, knee joint, and thigh, therefore considerably reducing his or her fatigue, and thereby allowing the walker to walk for a lengthy period of time.

Second, the present invention provides footwear for three-beat rhythm walking, which has a balance protrusion on an outsole, thus preventing the ankle of a walker, who walks in a three-beat rhythm, from being sprained, therefore allowing the walker to maintain his/her balance.

Third, the present invention provides footwear for three-beat rhythm walking, in which a first landing part, a second landing part, and a third landing part are formed to have correct proportions, so that the rolling landing surface has an optimum inclination angle, thus allowing a walker, walking in a three-beat rhythm, to walk optimally.

Fourth, the present invention provides footwear for three-beat rhythm walking, in which both an air cushion of an outsole and a shock absorbing unit of an insole function to absorb shocks, thus mitigating shocks acting on a walker who walks in a three-beat rhythm, and providing elasticity to the walker, therefore permitting rhythmic walking.

BRIEF DESCRIPTION OF THE DRAWINGS

FIG. 3 is a plan view of the footwear, according to the present invention;

FIG. 4 is a sectional view taken along line A-A of FIG. 3;

FIG. 5 is an exploded perspective view showing a shock absorbing unit of the footwear, according to the present invention;

FIG. 6 is a view showing three-beat rhythm walking of the footwear according to the present invention, in stages;

FIG. 7 is a view showing the inclination angle of a second landing part depending on the landing state of a first landing part, in stages, according to the present invention.

BEST MODE FOR CARRYING OUT THE INVENTION

Figure 1:
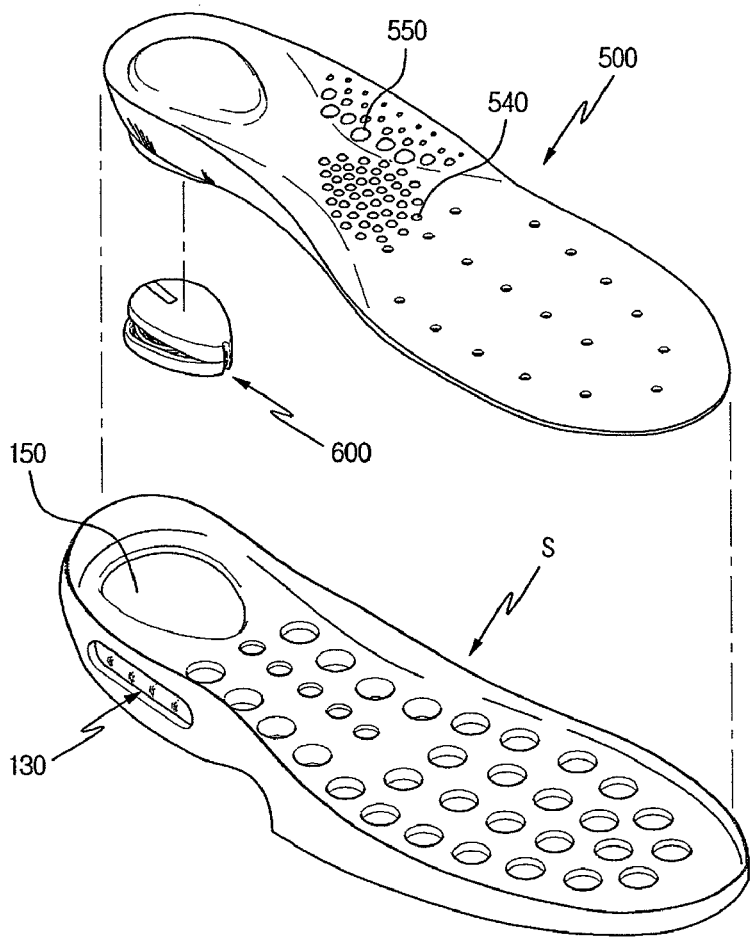
FIG. 1 is an exploded perspective view of footwear, according to an embodiment of the present invention.

Hereinafter, the preferred embodiments of the present invention will be described in detail with reference to the accompanying drawings.

As shown in FIGS. 1 to 7, the footwear according to the present invention includes an outsole S and an insole 500. The outsole includes a first landing part 100 having a landing guide groove 110, a rolling landing surface 120, and an air cushion 130, a second landing part 200, and a third landing part 300. The insole is attached to the upper surface of the outsole S, with a shock absorbing unit 600 installed in the insole.

Figure 2:
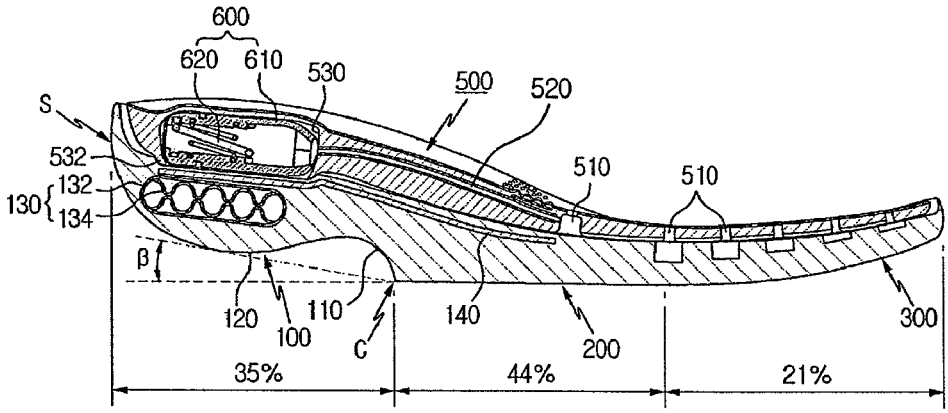
FIG. 2 is a side sectional view of the footwear, according to the present invention.

As shown in FIG. 2, the outsole S includes the first landing part 100 for landing the heel, the second landing part 200 for landing the center of the foot, and the third landing part 300 for landing the toes. A walker walks in a three-beat rhythm while the first landing part 100, the second landing part 200, and the third landing part 300 sequentially land on the ground.

Here, the first landing part 100 includes the landing guide groove 110, the rolling landing surface 120, and the air cushion 130.

The landing guide groove 110 is curved inwards from the junction C of the first landing part 100 and the second landing part 200, thus guiding the first beat of the three-beat rhythm walking.

The rolling landing surface 120 extends naturally from the rear end of the landing guide groove 110, and forms a continuous gentle curve toward the rear end of the outsole S. This rolling landing surface 120 provides flexibility to the first landing part 100, which smoothly guides the rolling of a walker's heel, prior to landing the heel on the ground.

FIG. 2 shows the state where the second landing part 200 lands on the ground. As shown in the drawing, the rolling landing surface 120 is inclined upwards from the junction C along the rear end of the outsole S, at 11 to 13 degrees. It is most preferable that the inclination angle β be 12 degrees. In this case, the inclination angle β of the rolling landing surface 120 is the angle between a segment, extending from the junction C to the tangent line of the rolling landing surface 120, and the ground.

The air cushion 130 is installed in a portion of the outsole S in contact with the walker's heel, thus absorbing shocks acting on the heel. Such an air cushion 130 includes a chamber 132 which is made of an elastic material to be elastically compressed and extended by the shocks of the heel, and is filled with air, and a shock absorbing protrusion 134 which is installed in the chamber to correspond to the upper and lower surfaces of the chamber 132, and elastically absorbs shocks of the heel.

Thus, while the rolling landing surface 120 of the first landing part 100 corresponding to the walker's heel smoothly rolls and lands, the first beat of the three-beat rhythm walking is formed by the landing guide groove 110. At this time, shocks acting on the heel are absorbed by the air cushion 130, thus preventing pain in the walker's ankle, calf, knee, and thigh.

The second landing part 200 lands the center of the walker's foot, thus forming the second beat of the three-beat rhythm walking. Such a second landing part 200 uniformly lands on the ground, thus balancing the walker who walks in three-beat rhythm.

The third landing part 300 forms a gently curved surface in such a way as to extend upwards from the second landing part 200 to the front end of the outsole S, thus forming the final beat of the three-beat rhythm walking. Such a third landing part 300 lands continuously as soon as the second landing part 200 lands, thus guiding the step of the walker who walks in a three-beat rhythm. That is, the third landing part 300 has the gently curved surface, thus leading to a natural propelling force while maintaining the walker's rhythmic walking.

The first landing part 100, the second landing part 200, and the third landing part 300, which are constructed as described above, have the proportion of 33~37%:42~46%:19~23% relative to the total length of the outsole S.

In a detailed description, the first landing part 100, which extends from the rear end of the outsole S to the junction C, having the landing guide groove 110, is 35% of the total length of the outsole S, the third landing part 300, which forms the gently curved surface, is 21% of the total length, and the second landing part 200, which is formed between the first landing part 100 and the third landing part 300, is 44% of the total length.

Such proportions are determined in order to guide the optimal three-beat rhythm walking in consideration of the proportion of the heel defining the overall shape of the foot, the foot arch corresponding to the center of the foot, and the toes.

Referring to FIGS. 3 and 4, a balance protrusion 400, which protrudes downwards, is integrally provided on a landing surface which is formed between a point spaced apart from the front end of the outsole S by 15% of the length thereof and a point spaced apart from the front end of the outsole by 45% of the length thereof, and extends widthwise from the outside end of the outsole S to a point spaced apart from the outside end by 30 to 40% of the width of the outsole. Such a balance protrusion 400 has a thickness l from 1 to 2 mm, and protrudes gently from the inside end of the outsole S to the outside end thereof.

Thus, the balance protrusion 400 functions to help the walker maintain his/her balance while three-beat rhythm walking. That is, while a step is transferred from the center of the foot to the toes in the three-beat rhythm walking, the toes land on the ground in the sequence from the little toe to the big toe. Hence, the portion of the outsole S contacting the little toe wears out first. Because of such abrasion, the walker's ankle may be sprained during the three-beat rhythm walking. However, the balance protrusion 400 prevents the walker's ankle from being sprained, thus appropriately maintaining the balance of the walker who walks in a three-beat rhythm.

The insole 500 having the shock absorbing unit 600 is attached to the upper surface of the above-mentioned outsole S.

A plurality of vertical air holes 510 is bored through the anterior portion of the insole 500. The air holes are connected to communicate with each other. A mounting cavity 530 is formed in the bottom of the posterior portion of the insole 500, which is in contact with the heel, and is connected to the vertical air holes 510 via an air tube 520.

An end rim 532 protrudes along the outer end of the mounting cavity 530. Such an end rim 532 is placed on a seating recess 150 which is formed on the upper surface of the outsole S, and determines the position at which the insole 500 is attached to the outsole S.

The shock absorbing unit 600 is mounted to the mounting cavity 530 of the insole 500, thus elastically absorbing shocks of the heel.

The shock absorbing unit 600 includes a casing 610 and an elastic member 620. The casing 610 is made of an elastic material, and is provided with an air supply hole 618 for supplying air to the vertical air holes 510 through the air tube 520. The elastic member 620 is installed in the casing 610, and elastically absorbs the shocks of the heel.

Here, the casing 610 includes a main body 612 and a cover 614 which is coupled to the main body 612 via a folding coupling piece 616 in such a way as to be opened or closed. Support rings 612*a* and 614*a* are provided in the main body 612 and the cover 614, respectively, to correspond to each other. The air supply hole 618 is bored through the folding coupling piece 616.

Preferably, the elastic member 620 comprises a coil spring and is supported by the support rings 612*a* and 614*a*. However, the elastic member 620 may be embodied by a plate spring, which elastically absorbs the shocks of the heel. As shown in FIG. 5, it is preferable that the elastic member 620 comprise at least two coil springs having different diameters.

Thus, when the first landing part 100 of the walker, walking in a three-beat rhythm, lands on the ground, both the casing 610 made of the elastic material and the elastic member 620 absorb shocks applied to the heel, and doubly perform a shock absorbing operation in cooperation with the air cushion 130 of the outsole S.

A plurality of first acupressure protuberances 540 is integrally formed on the insole 500, and presses the sole of the foot. Preferably, the first acupressure protuberances 540 are formed on a portion corresponding to the second landing part 200.

Further, a plurality of second acupressure protuberances 550 is integrally formed on the insole 500, and presses a Yung-Chuan region. These second acupressure protuberances 550 stimulate the Yung-Chuan region when the second landing part 200 lands on the ground. The stimulation of the Yung-Chuan region promotes the circulation of blood, thus eliminating harmful toxins and deposits.

Such an insole 500 is firmly attached to the upper surface of the sole S using an adhesive. Alternatively, the insole may be detachably attached to the inside of the footwear.

Reference numeral 140 denotes an iron piece which is inserted into the outsole.

The landing process during the three-beat rhythm walking will be described in detail with reference to FIGS. 6 and 7.

First, as shown in FIG. 6*a*, while the rolling landing surface 120 of the first landing part 100 contacts the ground, the heel smoothly rolls and lands. The footwear, which smoothly rolls and lands in this way, forms the first beat of the three-beat rhythm walking using the landing guide groove 110, as shown in FIG. 6*b*.

The inclination angle of the second landing part 200 when the first landing part 100 lands on the ground is shown in FIG. 7. When the air cushion 130 of the outsole S and the shock absorbing unit 600 do not perform shock absorbing operation, as shown in FIG. 7*a*, the inclination angle θ1 is 13°. Conversely, when the air cushion 130 of the outsole S performs the shock absorbing operation, as shown in FIG. 7*b*, the inclination angle θ2 is 15°. Further, when both the air cushion 130 of the outsole S and the shock absorbing unit 600 perform the shock absorbing operation, as shown in FIG. 7*c*, the inclination angle θ3 is 17°. As such, the inclination angle of 15 to 17° is the most suitable for correcting the walker's posture.

Further, shocks, which are transmitted to the walker when the first landing part 100 lands on the ground, are doubly absorbed by the air cushion 130 installed in the outsole S and the shock absorbing unit 600. As such, the double shock absorbing operation prevents the walker's ankle, calf, knee joint, or thigh from suffering pain, and provides elasticity while the walker walks in a three-beat rhythm, thus allowing the walker to walk for a lengthy period of time.

Next, when the second landing part 200 contacts the ground, as shown in FIG. 6*c*, the second beat of the three-beat rhythm walking occurs while the walker is balanced. At this time, the first landing part 100 is spaced apart from the ground.

Subsequent to the second landing part 200, the third landing part 300, comprising the gently curved surface, lands on the ground, as shown in FIG. 6*d*, thus allowing the walker to step naturally using his or her toes. In this way, the final beat of the three-beat rhythm walking is formed.

Meanwhile, when the step is transferred from the second landing part 200 to the third landing part 300, and the toes contact the ground in the sequence from the little toe to the big toe, the balance protrusion 400 formed on the outsole S prevents the ankle from being sprained, thus appropriately maintaining the balance of the walker who walks in a three-beat rhythm.

Further, as the first landing part 100 lands on the ground, the elastic member 620 of the shock absorbing unit 600 is compressed. At this time, air is supplied through the air supply hole 618 to the vertical air holes 510, thus making the interior of the footwear comfortable.

Figure 8:
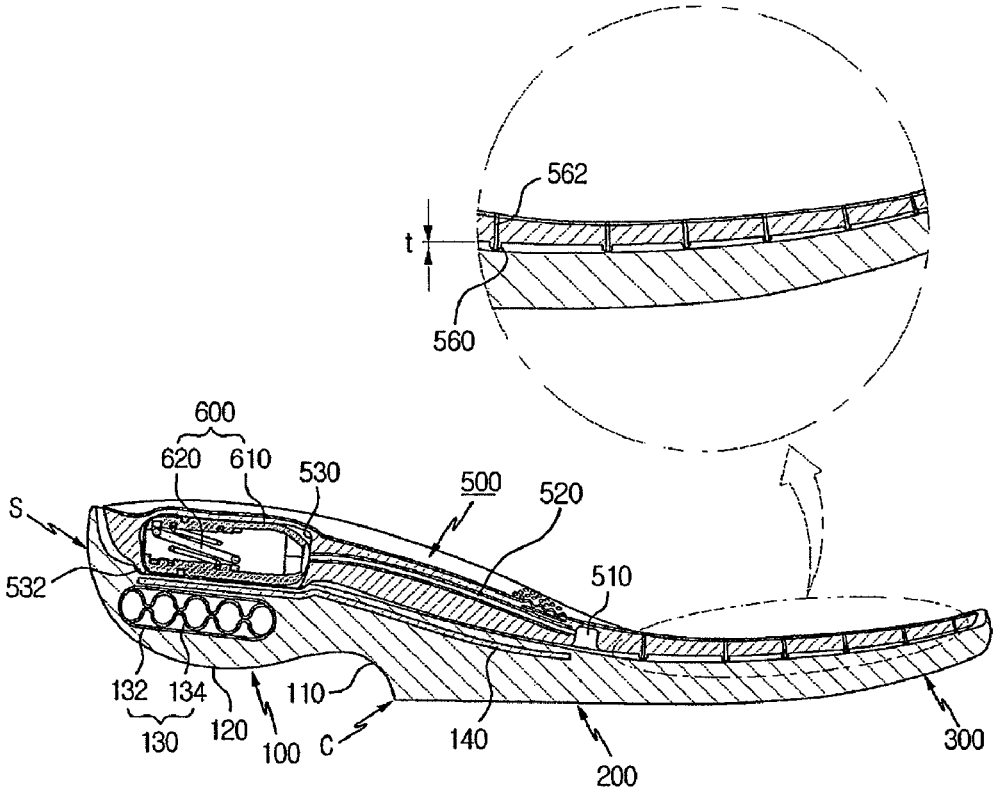
FIG. 8 is a side sectional view showing an insole of footwear, according to another embodiment of the present invention.

FIG. 8 is a side sectional view showing an insole, according to another embodiment of the present invention. A plurality of shock absorbing protuberances 560 is integrally formed on the anterior portion of the insole 500, and absorbs shocks of the third landing part 300 contacting the toes. Preferably, as shown in FIG. 8, the shock absorbing protuberances 560 are formed such that their heights t are reduced in the direction from the rear end of the insole to the front end thereof. That is, the shock absorbing protuberance adjacent to the second landing part 200 has a height t of about 2 mm. The height t of the shock absorbing protuberances is reduced in the direction from the second landing part to the front end of the insole 500 to sequentially have values of 1.5 mm, 1 mm, and 0.5 mm.

Moreover, a dispersion hole 562 is formed vertically through each shock absorbing protuberance 560 so as to disperse the shocks of the third landing part 300, thus dispersing shocks acting on the third landing part 300 to the dispersion holes 562.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. Footwear for three-beat rhythm walking comprising an outsole comprising a rearwardly positioned first landing part, a generally centrally positioned second landing part located forwardly of the first landing part, and a forwardly positioned third landing part for landing a forward portion of a user's foot, wherein the first landing part comprising:

a landing guide groove curved inwardly from a junction of the first landing part and the second landing part in such a way as to extend widthwise such that a user's heel lands on a ground surface first when walking;

a rolling landing surface connected to the landing guide groove to form a continuous curve, thus guiding landing and rolling of a user's heel; and an air cushion which absorbs shock applied to a heel as the heel lands and rolls;

said footwear further comprising an insole disposed on an upper surface of the outsole, the insole comprising a plurality of vertical air holes extending through the insole and in communication with each other; a mounting cavity in communication with the vertical air holes and defined in a lower surface of the insole proximate said first landing part of said outsole; and a shock absorbing unit disposed in the mounting cavity to elastically absorb shocks applied to the heel and to supply air to the vertical air holes, the shock absorbing unit comprising:

a casing comprising an elastic material and an air supply hole to supply air through an air tube to the vertical air holes; and an elastic member provided in the casing for absorbing shocks applied to the heel, wherein the casing comprises a main body and a cover which is coupled to the main body via a folding coupling piece, the air supply hole formed in the folding coupling piece.

2. The footwear according to claim 1, wherein the air cushion comprises:

an air-filled chamber comprising an elastic material which is elastically compressed and extended by the shocks applied to a user's heel; and a shock absorbing protrusion provided in the chamber to correspond to upper and lower surfaces of the chamber, and to absorb shocks applied to the heel.

3. The footwear according to claim 1, further comprising a plurality of shock absorbing protuberances is integrally provided on the lower surface of the insole to absorb shocks applied to the third landing part during landing of a forward portion of a foot.

4. The footwear according to claim 3, further comprising a dispersion hole extending vertically in each of the shock absorbing protuberances to disperse the shocks applied to the third landing part.

5. The footwear according to claim 4, wherein a height of each of the shock absorbing protuberances is reduced in a direction from a rear portion of the insole to a front portion of the insole.

6. The footwear according to claim 1, wherein the elastic member comprises a coil spring, and support rings in the main body and the cover to support said coil spring.

7. The footwear according to claim 1, comprising a plurality of first acupressure protuberances is integrally provided on the insole for pressing the sole of a foot.

8. The footwear according to claim 1, further comprising an end rim which protrudes from an outer end of the mounting cavity, and a seating recess on an upper surface of the outsole.

9. The footwear according to claim 1, wherein an inclination angle between a segment extending from the junction of the first landing part and the second landing part to a tangent line of the rolling landing surface and the ground is from 11° to 13°.

10. The footwear according to claim 1, wherein the first landing part, the second landing part, and the third landing part have proportions of 33~37%:42~46%:19~23% relative to a total length of the outsole.

11. The footwear according to claim 1, wherein the first landing part is spaced apart from the ground when the second landing part is mostly positioned on the ground.

12. The footwear according to claim 1, further comprising a balance protrusion integrally provided on the outsole and protruding downwardly, the balance protrusion allowing a walker's toes to approach the ground in a sequence from a little toe to a big toe, when a step is transferred from the second landing part to the third landing part.

13. The footwear according to claim 3, wherein an end rim protrudes from an outer end of the mounting cavity, and a seating recess is formed on an upper surface of the outsole.

14. The footwear according to claim 7, further comprising a plurality of second acupressure protuberances is integrally provided on the insole for pressing a Yung-Chuan region of the sole.

* * * * *